United States Patent [19]

Banys et al.

[11] Patent Number: 4,864,800

[45] Date of Patent: Sep. 12, 1989

[54] DEVICE AND METHOD FOR BAGGING THIN FLEXIBLE MEMBERS

[75] Inventors: Algis R. Banys, Reno, Nev.; Richard S. Welsh, Truckee, Calif.

[73] Assignee: Famoso Equipment Co., Inc., Sparks, Nev.

[21] Appl. No.: 186,565

[22] Filed: Apr. 27, 1988

[51] Int. Cl.[4] ..... B65B 35/50; B65B 39/12

[52] U.S. Cl. ..... 33/428; 53/113; 53/260; 53/459; 53/570; 53/385

[58] Field of Search ..... 53/459, 428, 429, 113, 53/116, 574, 577, 570, 385, 384, 390, 254, 447, 260, 255

[56] References Cited

U.S. PATENT DOCUMENTS

| | | | |
|---|---|---|---|
| 1,992,166 | 2/1935 | Beauclerk | 53/260 X |
| 2,656,082 | 10/1953 | Brown | 53/113 |
| 3,022,620 | 2/1962 | Gallet | 53/573 X |
| 3,699,741 | 10/1972 | Norman | 53/255 X |
| 4,219,989 | 9/1980 | Andrews | 53/260 X |

*Primary Examiner*—James F. Coan

*Attorney, Agent, or Firm*—Lyon & Lyon

[57] ABSTRACT

A device and method for bagging thin flexible members such as a stack of tortillas having a curved pan for accepting and bending the stack of tortillas, a bagging head for opening and positioning a bag adjacent curved pan and an actuator for inserting the curved pan with the stack of tortillas thereon into the opened bag and transferring the bag with the tortillas therein onto a conveyor.

21 Claims, 8 Drawing Sheets

DEVICE AND METHOD FOR BAGGING THIN FLEXIBLE MEMBERS

BACKGROUND OF THE INVENTION

The field of the present invention relates to methods and devices for bagging a stack of thin flexible members.

Heretofore there have been almost no devices available for automatically bagging food items comprised of thin flexible members. Bagging is typically accomplished manually. With the relatively recent advent of automatic tortilla stackers and counters, it has become more desirable and necessary to have an automatic bagger to accompany these devices. An automatic bagging device known to the Applicants is that of a bread bagger believed to be owned and operated by United Bakery Equipment Company. However, the logistics and technique for bagging a stack of tortillas for example is much different than for bagging a loaf of bread. The existing bagging device inserts the product into a bag by pushing the product from one end which requires some rigidity or stiffness of the product in order for it to be pushed into the bag. Further, this pushing action may damage or crumple less durable products.

One automatic bagging device takes two sheets of sealable material, positions one layer over the stack and one layer beneath the stack, and seals the two layers together at the edges. This device produces a bagged goods of a different appearance to the desired look of a bag of tortillas expected by consumers and also requires a complicated sealing process where all sides of the bag must be sealed after insertion of the product.

There are many difficulties encountered when attempting to bag a stack of thin flexible members. The stack should be fully and gently moved and supported throughout the bagging process, the integrity of the stack should be maintained (i.e., keep the stack straight), and the stack of tortillas should have a close fit within the bag to minimize bagging material costs.

SUMMARY OF THE INVENTION

The present invention is directed to a device and method for bagging thin flexible members. More particularly the invention is directed to bagging tortillas or other thin flexible dough members which may be stacked such as pitas, mushu pork wrappers, egg roll wrappers and the like. Actually the present invention may also be applicable to non-food items such as paper goods, flexible thin plastic members, leather or vinyl goods, articles of clothing, or the like. The present invention may be applied to bag a stack of one or more flexible members—items which may typically be laid relatively flat and horizontal, and if desired stacked vertically.

Though the present invention will be particularly described with respect to a stack of tortillas, it is understood that many more applications are envisioned and possible. By way of example, a stack of tortillas may be placed on a curved pan or chute and a bag is drawn into position next to the stack on the pan with the bag being open toward the stack. The curved pan with the stack thereon may then be moved into the bag. By continuing the movement of the curved pan, the bag may be removed from the holder. As the curved pan with the stack thereon and the bag therearound reaches a conveying means, the curved pan is abruptly stopped and/or reversed allowing the momentum of the stack to pull the bag off of the pan and slide onto a conveyor means.

DETAILED DESCRIPTION OF THE PREFERRED EMBODIMENTS

The preferred embodiments will now be described with reference to the Figures. For convenience of description, any element identified by a numeral in one figure will be represented by the same numeral in any other figure.

Figure 1:
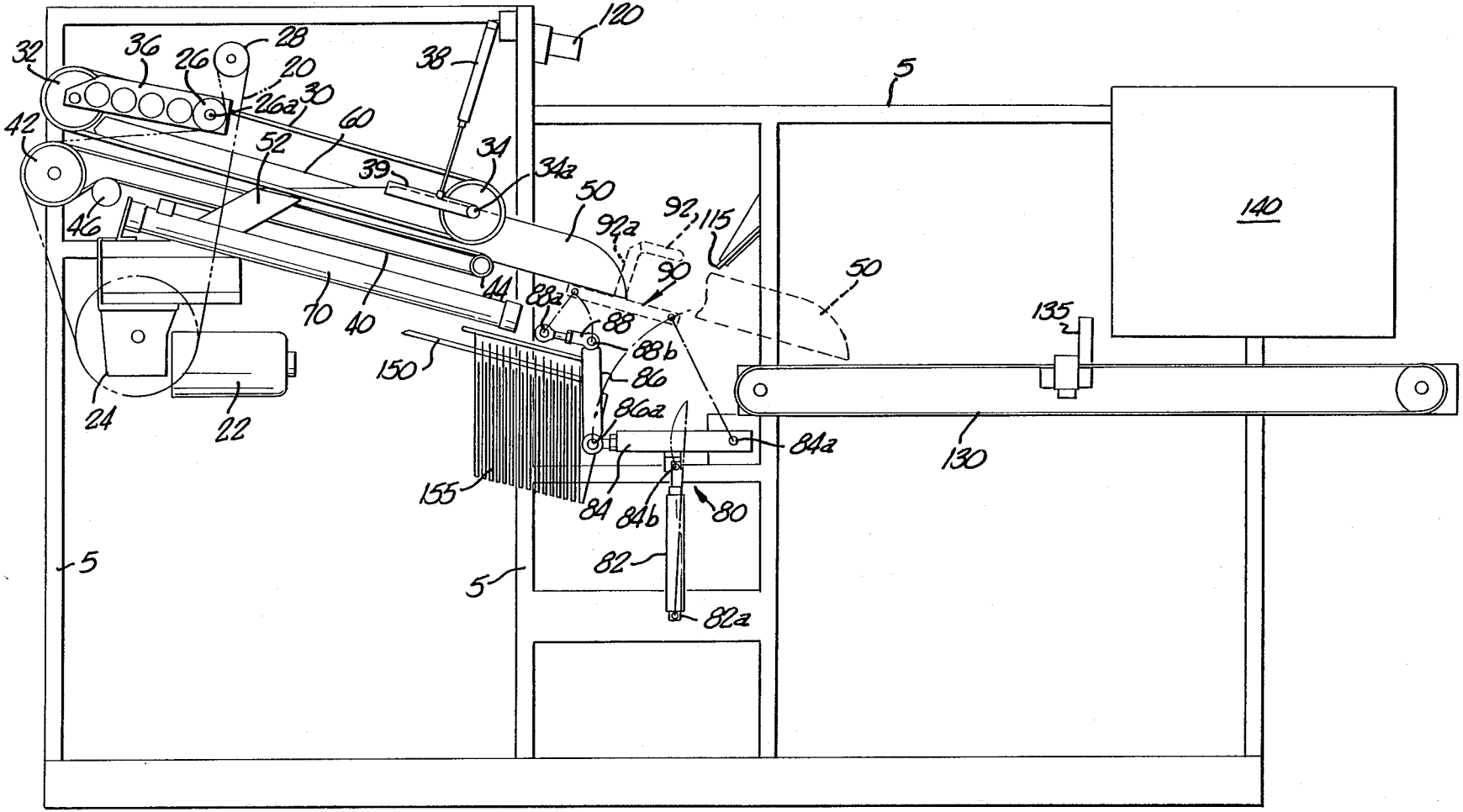
FIG. 1 is a diagrammatic side elevation view of a bagging mechanism according to the present invention.
Figure 2:
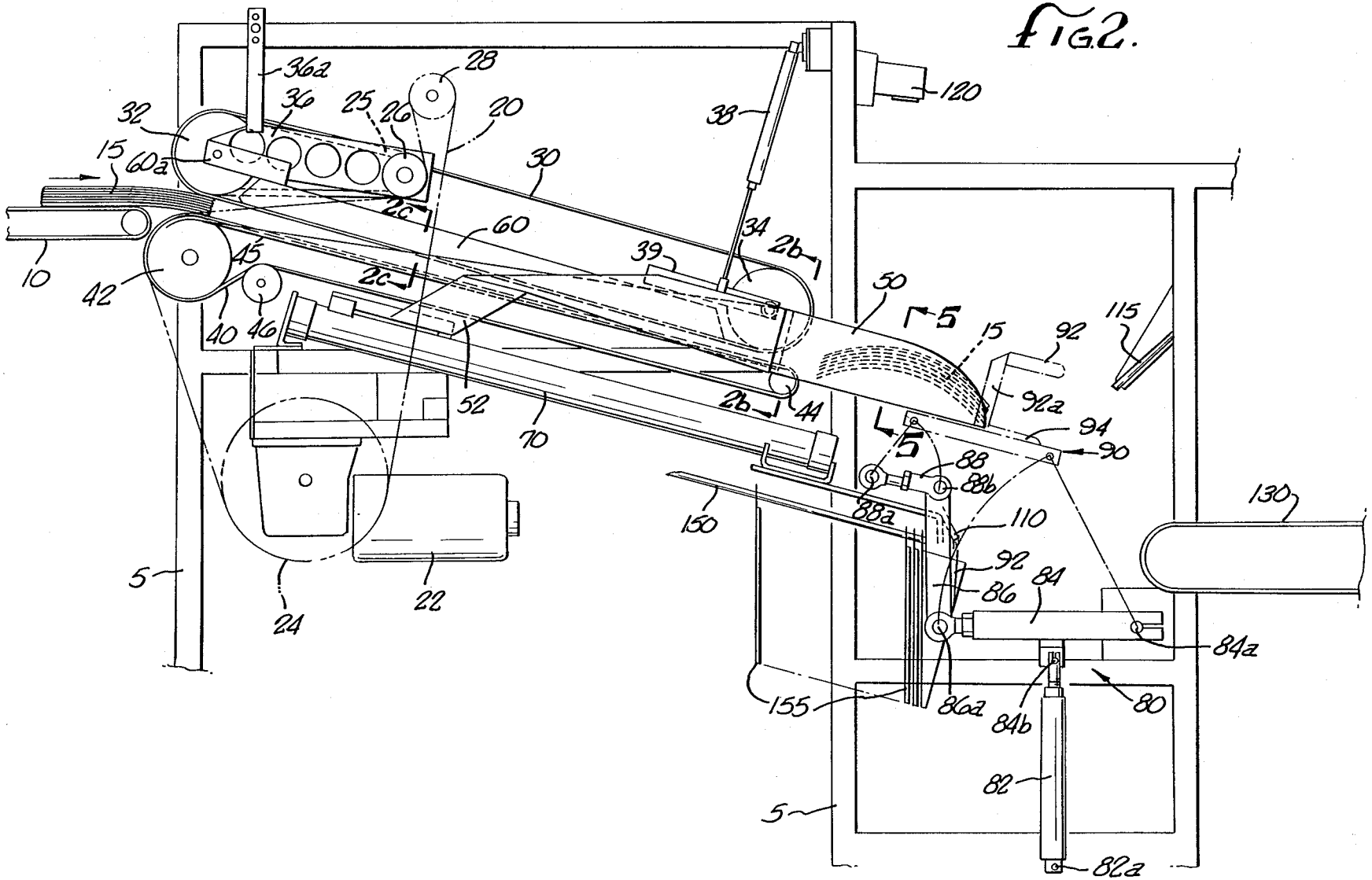
FIG. 2 is an enlarged and detailed side elevation view of the bagging mechanism of FIG. 1.

FIGS. 1 and 2 generally illustrate a device of the preferred embodiment which may be used for bagging a stack of thin flexible members such as tortillas. A stack of tortillas 15 is conveyed into position along an inlet conveyor 10 where the stack 15 is grabbed between a belt 30 and a belt 40. The belt 40 rotates around pulleys 42 and 44. An additional pulley 46 is located adjacent the pulley 42 to provide additional clearance for elements below the belt 40. The pulley 46 if adjustably mounted may also provide a tensioning means for the belt 40.

The belt 30 rotates between pulleys 32 and 34 which are rotatably connected at the opposite ends of a tubular pulley frame member 60. Referring to FIG. 2, to provide both the desired clearance and the compressive pressure between belts 30 and 40, both of the pulleys 32 and 34 are allowed to move vertically. The pulley 32 is rotatably secured on a drive arm 36 and to a frame arm 60*a*. The frame arm 60*a* is attached to a tubular pulley frame member 60. The upstream end of this unit for the upper belt 30 is supported by a flexible strap 36*a* attached between the drive arm 36 and the main frame 5 such that when a stack of tortillas 15 enters between pulleys 32 and 42, the pulley 32 may float vertically to accommodate a variable height stack of tortillas while the weight of the components applies the desired compressive force thereon. The length of the strap 36*a* may be varied to adjust the resting position of the upstream end of the belt 30.

The downstream pulley 34 is rotatably connected to arm 39 which is in turn attached to the frame member 60. Pulley 34 may also move vertically by means of a cylinder 38 which is attached to a follower arm 39. The arm 39 is connected to the pulley shaft about which the pulley 34 rotates. Cylinder 38 operates as a biasing means or spring to provide downward pressure to the pulley 34. The pressure applied is selected so as to compress the stack 15 for proper bending.

A drive means is provided to rotate belts 30 and 40 at the same speed. A motor 22 rotates a primary drive pulley 24 at a rate which produces the desired belt speed. The primary drive belt 20 is rotated by the primary drive pulley 24 and in turn drives the belt 40 by rotating the pulley 42 in a clockwise direction as viewed in FIGS. 1 and 2. The belt 30 is driven in a counter clockwise direction as viewed in FIGS. 1 and 2 as the primary belt rotates pulley 26, which in turn drives pulley 32 through secondary drive belt 25. The pulley 28 allows return of the drive belt 20 to the primary drive pulley 24.

As a stack of tortillas 15 is moved along as gripped between belts 30 and 40, the stack 15 is slid onto the end of a curved chute or pan 50. For a typical stack of tortillas, the belts 30 and 40 are only approximately 1 inch in width and grip the stack 15 therebetween, slightly compressing the stack 15, and eventually depositing the stack 15 at the end of the chute 50. The width of the belts 30 and 40 and the compression force applied may be chosen depending on the item being bagged. The belt 30 may also be supported by a curved folder arm 60 on each side of the upper belt 30.

Figure 2A:
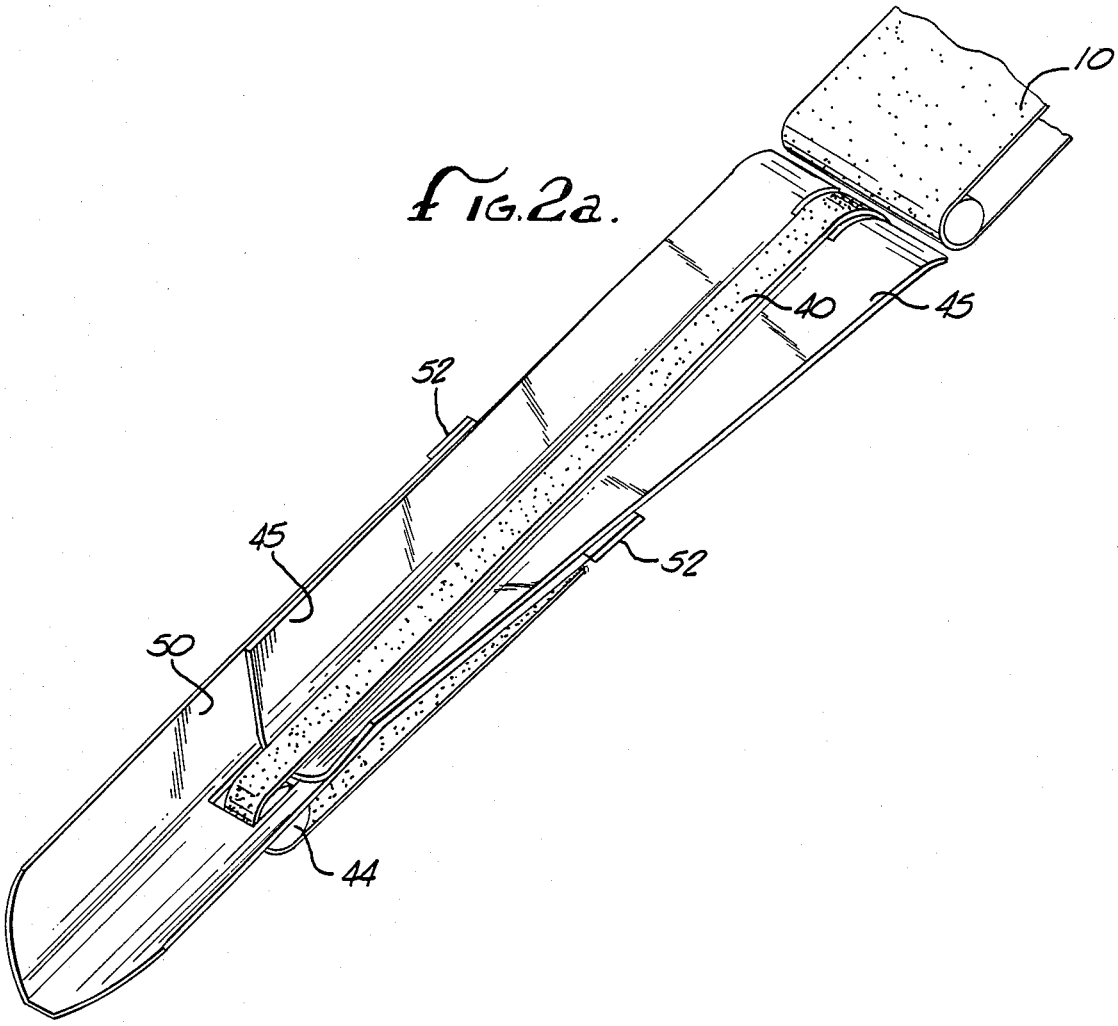
FIG. 2*a* is a perspective view of the forming pan of FIG. 2.
Figure 2C:
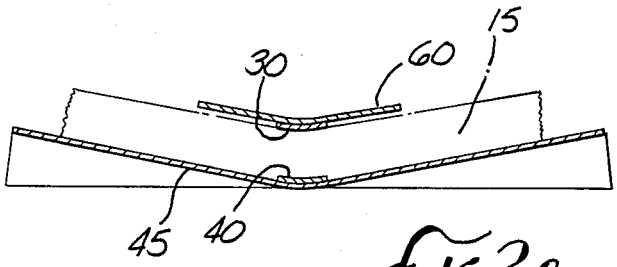
FIG. 2*c* is a cross-sectional view of FIG. 2 taken along the line 2*c*–2*c;*
Figure 2B:
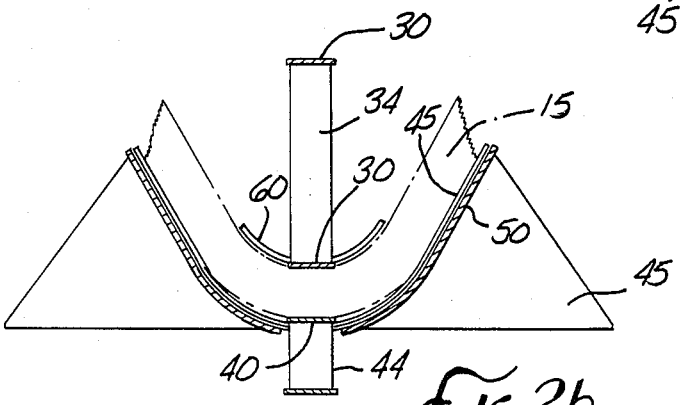
FIG. 2*b* is a cross-sectional view of FIG. 2 taken along the line 2*b*–2*b;*

The stack of tortillas is preferably bent into a "U" shape for insertion into a bag. Referring to FIGS. 2, 2*a*, 2*b* and 2*c*, the preferred means for bending has a forming pan 45 along the upper flight of the lower belt 40 extending from near the inlet conveyor 10 to the curved chute 50. The sides of the forming pan 45 begin in a flat or horizontal position at pulley 42 where the stack of tortillas is originally placed on the forming pan 45, and then the sides of forming pan 45 gradually curve upward (see FIG. 2*c*) until the cross-section of the forming pan 45 is in a "U" shape (see FIG. 2*b*) which corresponds to the curved chute 50. The upper flight of the lower belt 40 contacts the stack of tortillas and slides along the top of the forming pan 45. As shown in FIGS. 2*a* and 2*b*, the downstream end of the forming pan 45 may actually fit inside the curved chute 50 so that as the belts 30 and 40 slide the stack 15 along the forming pan 45, the stack is gently bent and then neatly dropped into the curved chute 50. The curved chute 50 has a slot in its bottom near its upstream end fitting around the belt 40 and the pulley 44.

Figure 5:
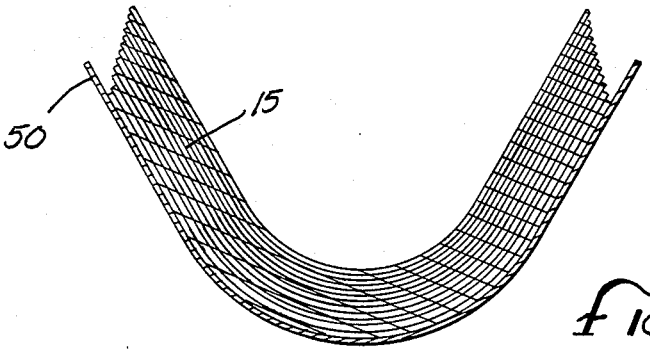
FIG. 5 is a cross-sectional view of the tortillas in a curved pan as in FIG. 2 or FIG. 6 taken along the line 5—5.

Alternately, instead of the separate forming pan 45, the curved chute 50 may be extended back (this alternative not shown) to the inlet conveyor 10. The chute 50 would have a slot or opening at the bottom along its axis to permit the belt 40 to contact the stack of tortillas 15. The sides of chute 50 would begin in a flat or horizontal position at pulley 42 where the stack of tortillas would be originally placed on the chute 50, and then the sides of chute 50 would gradually curve upward until the cross-section of chute 50 is in a "U" shape as viewed in the cross-section of FIG. 5.

One advantage of the preferred device of the forming pan 45 is speed. The chute 50 as illustrated may be in operation moving a stack toward the outlet conveyor 130 while simultaneously another stack is being moved along the forming pan 45.

Returning to the illustrated embodiment, once a stack of tortillas is placed in the end of the curved chute 50 as may be detected by a detecting means such as proximity switch 120, the chute 50 is moved longitudinally forward into an open bag which is opened and positioned by a bagging head means generally depicted by numeral 90 which will be described in greater detail below. The rear end of the chute 50 is connected through a chute connector 52 to a chute actuator mechanism 70 which provides the desired longitudinal moving action for the chute 50.

The bagging head means 90 provides means to position and open a bag adjacent to the chute 50 allowing the chute 50 with the tortilla stack 15 thereon to be inserted into the open bag. As the chute 50 travels forward, the bag is removed from the bagging head 90 and the chute 50, with the stack thereon and with a bag therearound, are moved toward an outlet conveyor 130. The chute 50 is abruptly stopped and/or reversed and the momentum of the stack of tortillas 15 pulls the bag off the chute 50 gently depositing onto the outlet conveying means 130. The outlet conveying means 130 then transfers the bagged stack of tortillas to the bag sealer 140 which may be activated by sensor means 135.

A bag dispenser may be provided which includes plurality of bags 155 placed upon a wicket 150. The wicket 150 is slanted at a downward angle so the bags 155 may slide downward into position to be grabbed by the bagging head means 90. The bagging head means 90 also includes a linkage movement assembly or bag positioning means generally depicted as numeral 80 which is comprised of an actuator 82 and links 84, 86, and 88. The bagging head means 90 is moved from the position adjacent the bags 155 to the position adjacent the chute 50 through the linkage movement assembly 80.

The linkage movement assembly 80 is operated by the actuator 82 which is pivotally attached to the frame 5 at a connection point 82*a*. The actuator 82 is pivotally attached to a first link 84 at a pivot point 84*b*. The first link 84 is pivotally connected to frame 5 at a pivot point 84*a*. A second link 86 is pivotally connected a second end of first link 84 at a connector 86*a*. A second end of second link 86 is pivotally connected to a third link 88 at a connector 88*b*. The third link 88 is connected at a second end to frame 5 at a connector 88*a*. Therefore as actuator 82 extends and retracts, the bagging head means 90, which is basically connected to second link 86, moves from its position at the stack of bags 155 to its position adjacent chute 50.

Figure 3:
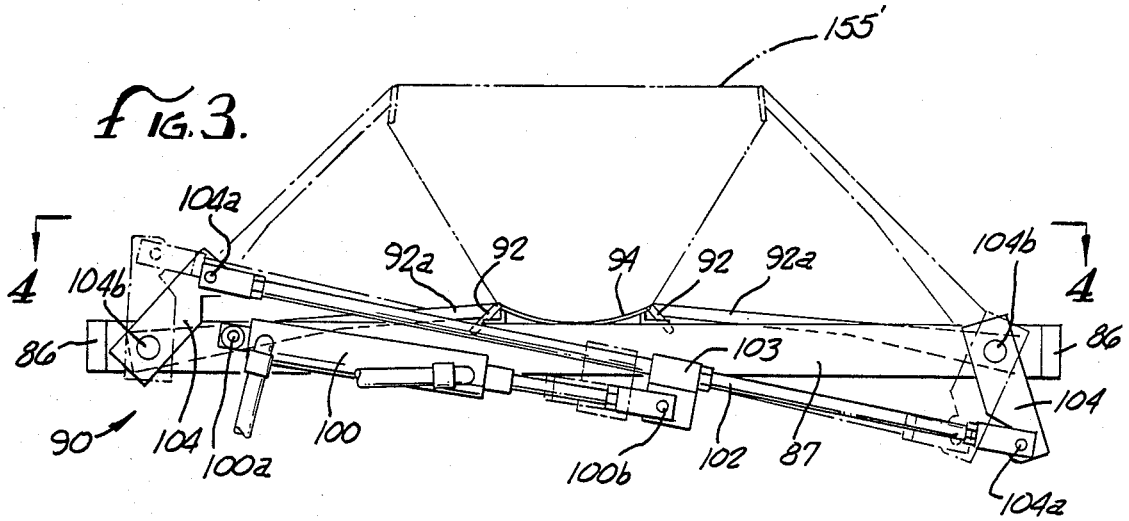
FIG. 3 is an end view of the bagging head means and its actuator.
Figure 4:
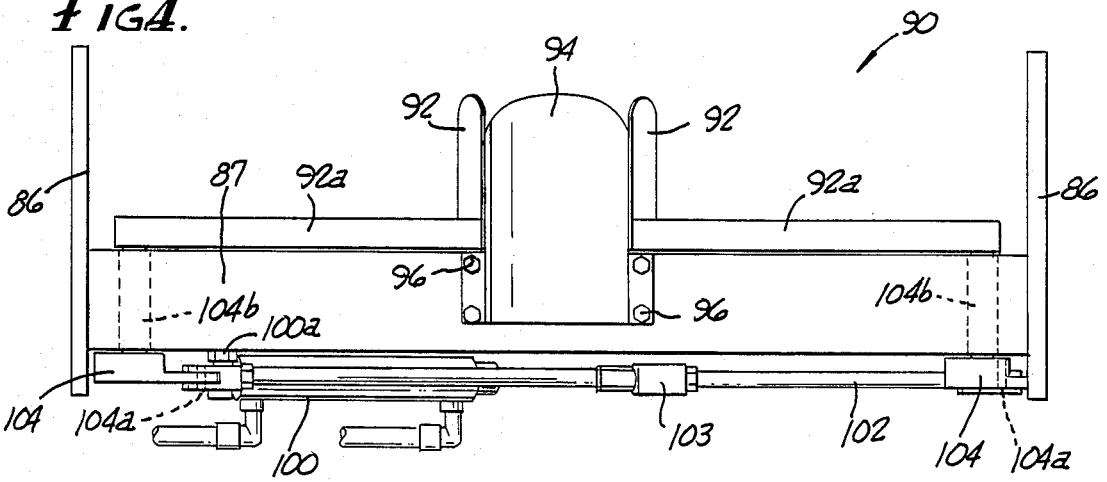
FIG. 4 is a plan view of the bagging head means of the preferred embodiment.
Figure 9:
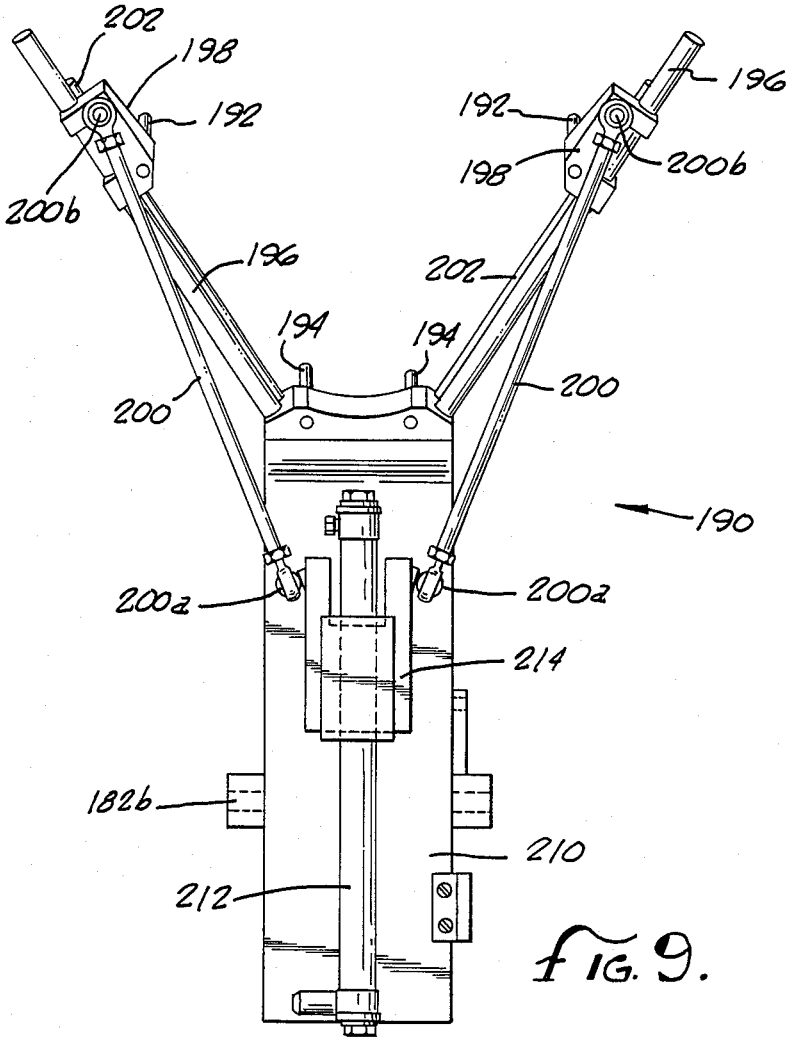
FIG. 9 is a detailed plan view of the alternative embodiment of the bagging head means.

The bag 155' is held and opened by the bagging head means 90 as described with particular reference to FIGS. 3 and 4. FIG. 3 illustrates the bagging head means 90 having two prongs or fingers 92, 92 and a shoe 94 which are insertable into a bag 155'.

Each prong 92 is attached to a prong arm 92*a* which pivots about a connector 104*b*. An arm linkage 104 also pivoting about connector 104*b* is attached to the prong arm 92*a*. A main linkage 102 is pivotally connected to a second end of each arm linkage 104, 104 and connectors 104*a*, 104*a*. An actuator 100 attached at one end to base 87 has its second end pivotally attached at connector 100*b* to main linkage 102. Therefore, as actuator 100 extends and retracts, the prongs 92, 92 go from the retracted condition to the extended position (which is represented in phantom in FIG. 3). The position of connector 100*b* of actuator 100 to the link 102 may be adjusted by an adjusting means 103. When the actuator 100 is in the extended position, the bag 155' is opened into a trapezoidal shape awaiting insertion of a stack.

FIGS. 6–9 illustrate an alternative embodiment for the bagging head means previously described. The alternative embodiment bagging head means is generally depicted by numeral 190. FIGS. 6–12 also functionally depict the bagging process which is applicable either to the preferred embodiment above or to the alternative embodiment to be described.

Figure 6:
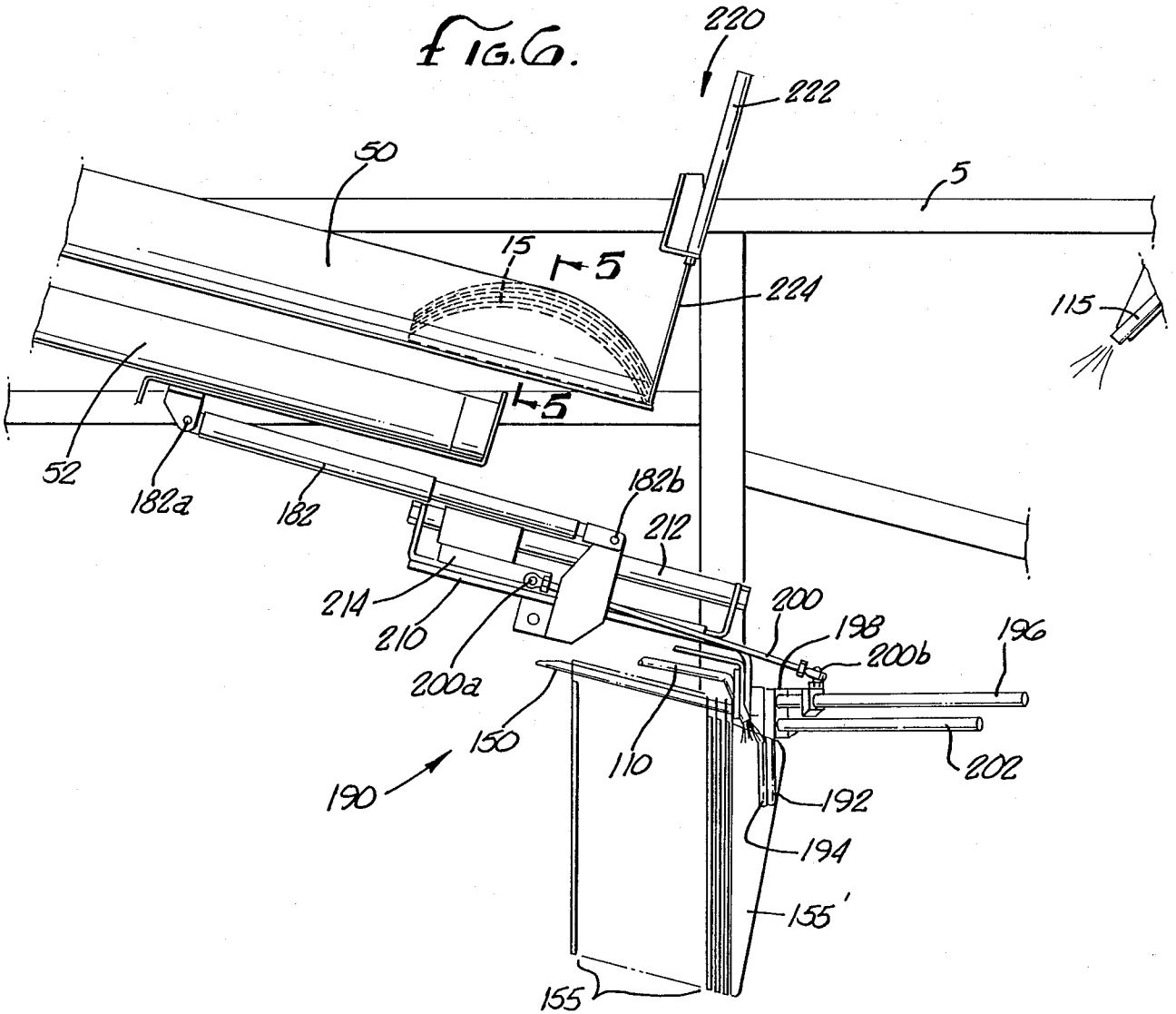
FIG. 6 is a side elevation view of an alternative embodiment of the bagging head means.

FIG. 6 illustrates a stack of tortillas 15 already placed on the curved chute 50 awaiting insertion into a bag. The chute 50 will be moved forward upon actuation of the cylinder 52 at the appropriate time. When ready, a puff of air is ejected out of puffer tube 110 into a bag 155' in order to open the bag 155' sufficiently to allow air from the blower 115 to enter and inflate the bag 155' thereby allowing the insertion of the prongs 192 and 194. The blower 115 blows air at a higher volume but at a lower pressure than the air of puffer tube 110. The puffer tube 110 may be connected to a compressed air supply while the blower 115 may be comprised of an air fan unit. Once inserted into the bag 155', the prongs 192 and 194 may be separated to open and hold the bag 155= The head 190 is then rotated upward to a position adjacent the stack of tortillas 15.

Figure 7:
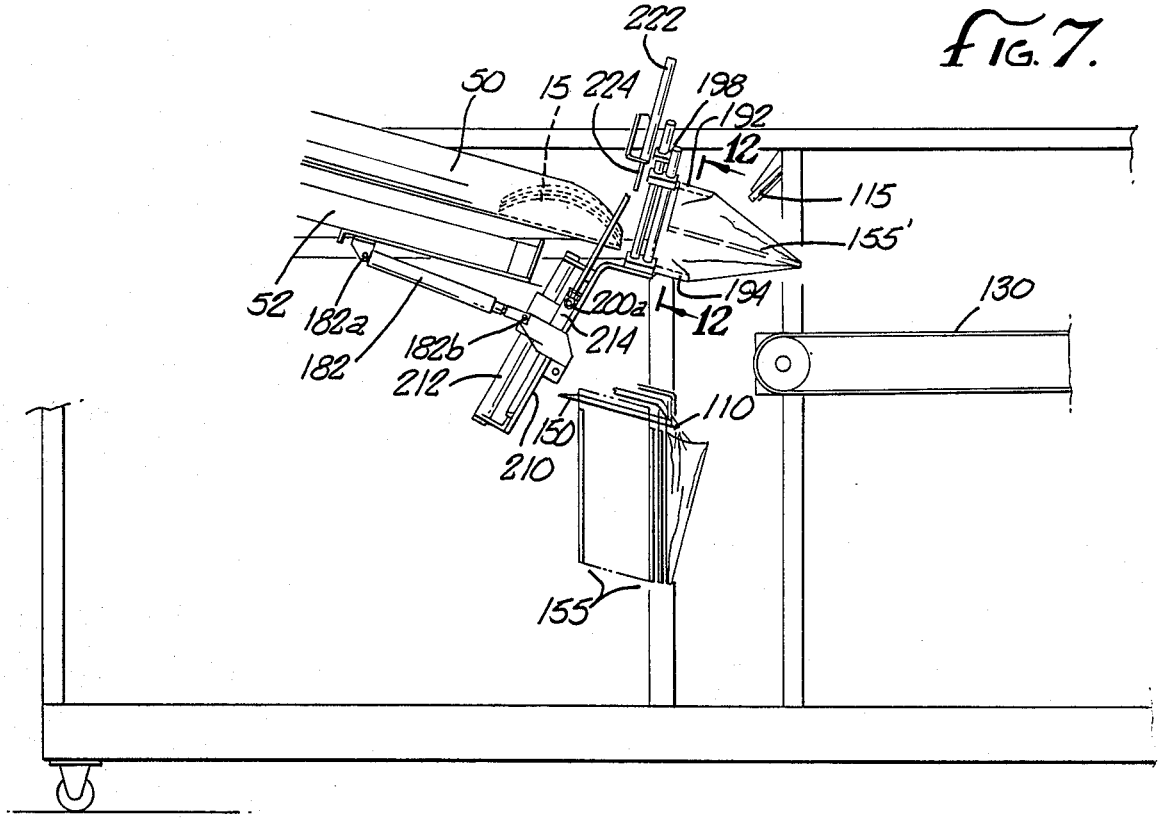
FIG. 7 and FIG. 8 are side elevation views of the alternative embodiment of the bagging head means showing two operative positions of the bagging process.

Referring now to FIG. 7 bag 155' is now in position adjacent the stack of tortillas 15 on the curved pan 50. Referring to the FIG. 12 cross-section, the four prongs 192 and 194 have separated and fully opened the bag 155' into a trapezoidal shape which readily accepts the insertion of the stack of tortillas 15 on the curved pan 50.

Figure 8:
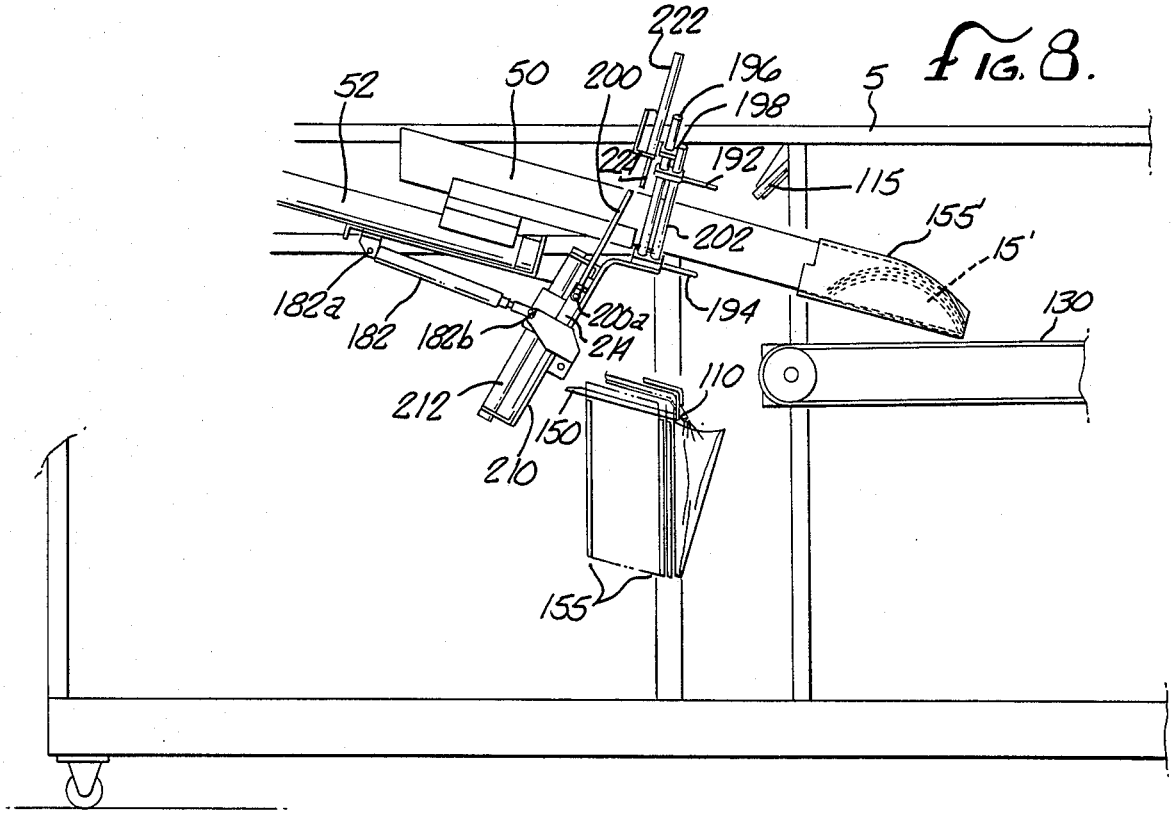

Referring to FIG. 8, the curved pan 50 has been moved forward removing the bag 155' from the prongs 192 and 194 bringing the stack of tortillas 15' in the bag 155' toward the conveyor 130. The motion of the curved pan 50 is abruptly stopped and/or reversed and the momentum of the stack of tortillas 15' pulls the bag 155' with the stack of tortillas 15' therein off of the curved pan 50 and onto the outlet conveyor 130.

Figure 10:
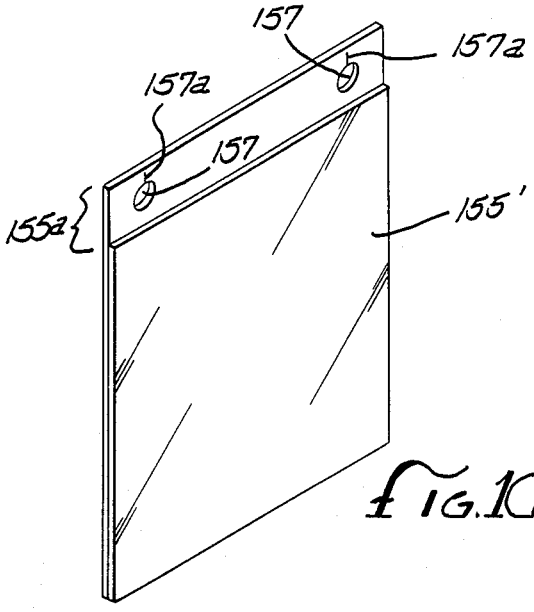
FIG. 10 is a perspective view of a single bag usable in the present invention.
Figure 11:
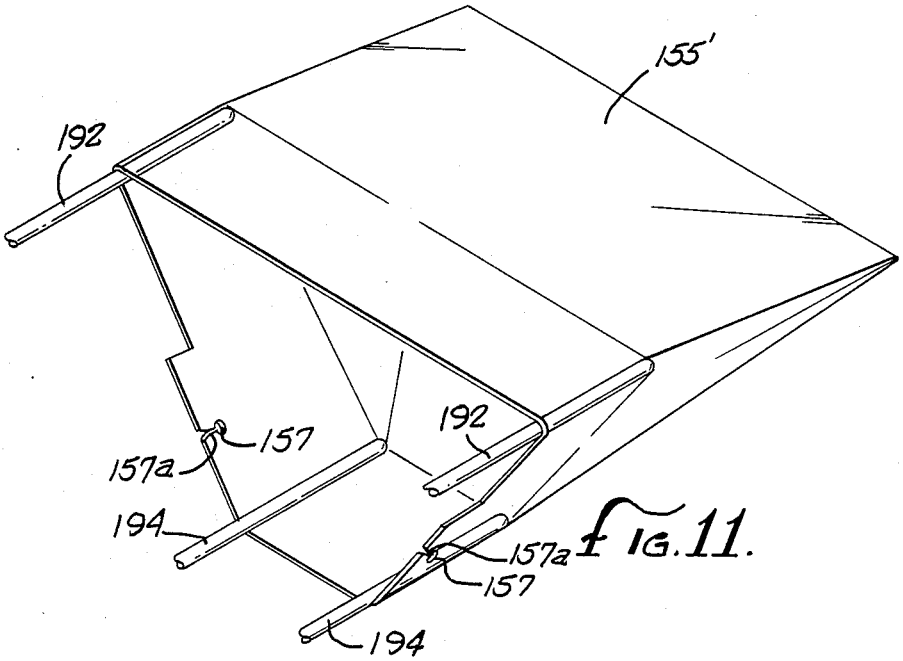
FIG. 11 is a perspective view of a bag opened by the prongs of a bagging head means according to the alternative embodiment of the present invention.
Figure 12:
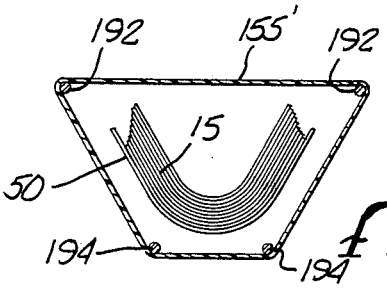
FIG. 12 is a cross-sectional view taken substantially along the line 12—12 of FIG. 7 showing how a stack of tortillas in a pan fits into an opened bag.

FIG. 10 illustrates a typical bag 155' which hangs on the two prong wicket 150 which slides through holes 157, 157 in the top portion 155*a* of bag 155'. An access line 157*a* such as a slit or perforation above each hole 157 allows for easy tearing or removal of a bag 155' from the wicket 150 by the bagging head means. After the stack of tortillas is bagged, the top portion 155*a* of the bag 155' may be removed if desired.

The alternate bagging head means 190 of the FIGS. 6–9 will now be described in detail. Generally a plurality of bags 155 hangs down on a bag wicket 150 from which the bagging head means 190 can remove a bag 155' from a position illustrated in FIG. 6 to the open position as illustrated in FIG. 7. The bagging head means 190 includes a positioning and an opening means. The positioning means is comprised of a cylinder 182 which is pivotally connected to the frame 5 at point 182*a*. On the opposite end of the cylinder 182 is the bag opening means which is pivotally connected at point 182*b*. The bag opening means is comprised of a main frame 210 on which an actuator 212 is positioned longitudinally as best viewed in FIG. 9. A pair of tie rods 200, 200 are pivotally connected to the actuator head 214 on the actuator 212 at pivot points 200*a*, 200*a*. The tie rods 200, 200 are pivotally connected to slider members 198, 198 at pivot points 200*b*, 200*b*. Each slider member 198 slides along extender rods 196 and 202. A pair of bag prongs 194, 194 extend outward from the base 210 of the bag opening means and a moveable bag prong 192 extends outward from each slider member 198.

Therefore as the actuator head 214 slides along actuator 212, the tie rods 200, 200 slide the slider members 198, 198 along rods 196, 196 thereby opening a bag with the bag prongs 194, 194 and the moveable prongs 192, 192.

FIGS. 6–8 also illustrate a tortilla stack stopping device generally depicted as element 220. The stack stopping device 220 is comprised of an actuator 222 which extends and retracts a stopper rod 224. When a stack of tortillas 15 is deposited onto the pan 50, the stopper rod 224 is in the extended position as viewed FIG. 6 preventing the stack 15 from sliding off the end of the chute 50. When the pan 50 and the stack of tortillas 15 is to be inserted into an open bag 155', the stopper rod 224 is retracted as viewed in FIGS. 7 and 8.

The preferred embodiment does not require the stack stopping device 220 but includes means for adjusting the relative speeds of the moving chute 50 and the belts 30 and 40. If the stack 15 does not slide far enough or slides too far down or off the chute 50, several adjustments may be made including: (1) increasing or decreasing the speed of the belts 30 and 40 to deposit the stack 15 properly at the end of chute 50; (2) increasing or decreasing the speed of the chute 50; and/or (3) adjusting the moment the chute 50 begins moving as a stack 15 is placed thereon.

By way of an example, if the stack 15 slides too far off of the chute 50, the speed of the chute 50 may be increased by increasing the stroke speed of the chute actuator 52. Alternately, the speed of the belts 30 and 40 could be reduced for example by reducing the speed of the motor 22. A third possible adjustment is to commence the movement of the chute 50 earlier in response to the detector means 120 sensing the deposit of a stack 15 onto the chute 50.

By this method and apparatus a stack of tortillas is formed into a U-shape to reduce its outside perimeter whereby a bag of a desired size can be fitted readily over the tortilla stack by a mechanical bag opening means with adequate clearance to insure consistent operation and yet when the tortilla stack is allowed to flatten, it tightly fits in the bag. The result is a most desirable package from the standpoint of appearance, maintaining a straight stack, minimizing bag material, easing of subsequent handling, and the like.

One advantage of the present invention is that the device may provide support for the item being inserted into the bag and does not push the item into the bag from one end. The item is fully supported resting on the curved chute 50. Therefore the item does not require rigidity or stiffness in order to be readily inserted into a bag. By not having to push the item, the item is not crumpled or otherwise damaged. By example, if one attempted to push a stack of tortillas into a bag, the stack would crumple and bunch up possibly damaging the tortillas. The present invention has solved this problem.

While embodiments of a method and device for bagging thin flexible members such as tortillas have been shown and described, it will be apparent to those skilled in the art that many more modifications are possible without departing from the described inventive concepts. Therefore, the invention is not to be restricted except in the spirit of the following claims.

What is claimed is:

1. A device for inserting a stack of thin flexible members into a bag having an open end comprising:
   a means for bending the stack into a curved shape;
   a chute for accepting the thin flexible members, said chute being moveable longitudinally and having a first end and a second end, with at least the second end of said chute being curved about a longitudinal axis forming a trough-like shape;
   bagging head means for opening and positioning a bag proximate to and with its open end facing the second end of said chute; and
   means for moving said chute longitudinally between a first position where the stack of thin flexible members is placeable on said chute, a second position within the bag, and a third position to discharge the bag and stack of thin flexible members from the chute.

2. The device of claim 1 further comprising a bag dispenser and wherein said bagging head means comprises a holder having a plurality of prongs, said prongs being insertable into a first bag in said dispenser and being separable to open and hold the bag, said holder being pivotable into position proximate said chute.

3. The device of claim 2 further comprising an air supply positioned adjacent the first bag in the dispenser for blowing air into and thereby opening the bag to allow insertion of said prongs.

4. The device of claim 1 wherein said air supply comprises an air puffer for initially opening the bag and an air blower means for completing opening of the bag.

5. The device of claim 1 further comprising a transfer means for placing the stack of thin flexible members on said chute.

6. The device of claim 5 wherein said transfer means comprises a first conveyor belt contacting a top of the stack and second belt running parallel to said first belt and contacting a bottom of the stack, said first and second belts engaging the stack therebetween.

7. The device of claim 5 further comprising a means for adjusting at least one of: (1) the speed of said transfer means, (2) the speed of said chute, and (3) the commencement of movement of said chute.

8. The device of claim 5 wherein said transfer means and said chute move at approximately the same speed as the stack is placed on the chute by the transfer means.

9. The device of claim 5 further comprising a means for detecting a stack being placed on said chute.

10. The device of claim 1 further comprising
   means for removing the bag and the stack of thin flexible members together from both said bagging head means and said chute onto an outlet conveying means.

11. A method of bagging a stack of a thin flexible members comprising the steps of:
   placing a stack on a curved pan;
   opening a bag with a holder;
   drawing the bag into position next to the stack on the curved pan, the bag being opened toward the stack;
   moving the pan with the stack thereon into the bag;
   removing the bag from the holder;
   moving the pan and the stack thereon toward an outlet conveying means; and
   stopping and/or reversing the pan abruptly and allowing momentum of the stack to carry the bag with the stack therein off the pan and onto the outlet conveying means.

12. The method of claim 11 wherein the steps of opening and drawing into position comprise
   positioning a holder having a plurality of prongs adjacent the opening of the bag;
   blowing air into the opening of the bag to open the bag and allow insertion of the prongs;
   inserting the prongs into the bag;
   separating the prongs of the holder to form a bag opening having a somewhat trapezoidal cross section; and
   pivoting the holder into position proximate said curved pan.

13. The method of claim 11 wherein the step of blowing air comprises blowing a burst of air into the opening of the bag to permit a subsequent stream of air to be blown into the bag.

14. The method of claim 11 further comprising selecting at least one of (a) the speed of the stack being placed on the curved pan, (b) the speed of the curved pan, and (c) the commencement of movement of the curved pan.

15. The method of claim 14 wherein the speed of the stack being placed on the curved pan is selected to be approximately the same as the speed of the curved pan.

16. A method of bagging a stack comprising the steps of
   placing a stack on a curved pan;
   opening and positioning a bag with its open end proximate to and facing a first end of said curved pan;
   moving the first end of said curved pan and the stack into the bag; and
   stopping and/or reversing the curved pan abruptly and allowing the momentum of the stack to slide the stack with the bag therearound off the pan and onto a conveying means.

17. The method of claim 16 wherein the step of opening and positioning comprises
   positioning a holder having a plurality of prongs adjacent the opening of the bag;
   blowing a burst of air into the opening of the bag to open the bag and allow insertion of the prongs;
   inserting the prongs into the bag;
   separating the prongs of the holder to form a bag opening having a somewhat trapezoidal cross section; and
   pivoting the holder into position proximate said chute.

18. The method of claim 16 further comprising blowing air into the bag as it is drawn into position proximate said chute.

19. The method of claim 16 further comprising detecting the placement of a stack onto the curved pan and commencing moving of the curved pan in response to the detecting.

20. A method of bagging tortillas comprising the steps of:
   bending a stack of tortillas;
   placing the stack of tortillas on a curved pan;
   opening a bag with a holder;
   drawing the bag into position next to the stack of tortillas on the curved pan, the bag being opened toward the stack of tortillas;
   inserting the stack of tortillas into the bag by sliding the pan with the stack of tortillas thereon into the bag;

removing the bag from the holder by moving the curved pan toward a conveying means; and placing the bag of tortillas onto the conveying means by stopping and/or reversing the movement of the curved pan abruptly and allowing momentum of the tortillas to carry the bag with the stack of tortillas therein off the pa and onto the conveying means.

21. A method of bagging a stack of thin flexible members comprising the steps of:

forming the stack into a curved shape, opening a bag to face the stack, inserting the stack into the open bag and supporting the stack in the bag causing the bag and stack to move together in a direction away from the opening of the bag while supporting the stack, and abruptly terminating the movement of the support of the stack to cause the momentum of the stack to discharge from the support while remaining positioned in the bag.

* * * * *